US005560183A

United States Patent [19]

James

[11] Patent Number: 5,560,183

[45] Date of Patent: Oct. 1, 1996

[54] BLISTER PACKAGE COLLATOR AND STACKING APPARATUS, SYSTEM AND METHOD

[75] Inventor: Donald R. James, Barnstable, Mass.

[73] Assignee: Sencorp Systems, Inc., Hyannis, Mass.

[21] Appl. No.: 332,929

[22] Filed: Nov. 1, 1994

[51] Int. Cl.[6] ..... B65B 35/56

[52] U.S. Cl. ..... 53/446; 53/447; 53/542; 53/544; 53/143

[58] Field of Search ..... 198/374, 402; 414/791.3, 788.2, 788.3; 53/142, 143, 446, 447, 448, 540, 542, 544

[56] References Cited

U.S. PATENT DOCUMENTS

| | | | |
|---|---|---|---|
| 3,313,394 | 4/1967 | Mills et al. | 53/143 X |
| 4,530,435 | 7/1985 | Stohlquist | 53/544 X |
| 4,731,977 | 3/1988 | Maekawa | 53/143 X |
| 4,901,502 | 2/1990 | Colamussi | 53/143 |

FOREIGN PATENT DOCUMENTS

| | | | |
|---|---|---|---|
| 587745 | 5/1977 | Switzerland | 53/143 |
| 658235 | 10/1986 | Switzerland | 53/143 |

*Primary Examiner*—John Sipos

*Assistant Examiner*—Daniel Moon

*Attorney, Agent, or Firm*—Richard P. Crowley

[57] ABSTRACT

A collator and stacking apparatus, system and method for the collation and stacking of asymmetric plastic blister packages having a blister at or toward one end on a flat card, which comprises package-receiving inverter and sliding trays each with a tray surface, upwardly extending sides and a one and other end, for receiving each a package thereon, the received package being in the same orientation on each tray surface. The inverter trays have stops to position the received package on the tray surface as it moves between a package receiving position and an inverted package discharge position, wherein the package is inverted and placed within a collation track perpendicular to the trays, the track having a first and second end for receiving periodically an inverted package from the inverter tray and a slidable package from the sliding tray in a spaced-apart alternating arrangement within the track rails. The sliding tray moves between the package receiving position and a package discharge position, wherein the packages are slidably discharged from one end of the sliding tray in an oriented stacked position onto the track, by a second overhead stripper arm. A stacking device moves between the first and second end of the track, stacking the inverted and oriented packages, which are then discharged from the one end of the track into a packaging carton.

25 Claims, 7 Drawing Sheets

BLISTER PACKAGE COLLATOR AND STACKING APPARATUS, SYSTEM AND METHOD

DESCRIPTION

BACKGROUND OF THE INVENTION

There are many plastic blister packaging systems and methods which provide for the encapsulation or packaging of one or more articles within a plastic thermoformable blister, typically a transparent blister, which blister is usually secured to a flat paper card. The blister package optionally may have a window in the card about which the plastic blister is sealed to enclose the packaged article or articles.

For example, a typical blister packaging system may comprise a card-receiving station wherein a flat paper card is provided which may be perforated along a line of the card, which card may have a window aperture cut therein. The system would then include a receiving and positioning station, in which a flat, thermoformable plastic sheet material, such as polyvinylchloride or other thermoformable plastic, is cut to a size slightly larger than the aperture of the card and positioned over the aperture. The system may also include a plastic heat-bonded packing station, wherein the plastic card may be peripherally or tack scaled about the window of the card. The system would include a blister forming and a blister sealing station in which a blister is formed in the thermoformable material by a heated die and the blister edges sealed about the peripheral openings. The system usually includes a blister filling station, generally which may be adjacent an article discharging machine, such as an injection molding machine, so that the article or articles to be packaged, for example, for the purposes of illustration only, batteries, may be inserted directly within the blister. The system would then include a package covering station, in which the card is folded over to cover the back of the aperture, then a package sealing station in which the back of the card is sealed across the back of the aperture in the card to enclose the article within the transparent blister. The packaging system generally also includes a "pick and place" device, in which the individual blister packages are then picked up and placed as desired in a collation and stacking device. The blister packages are collated and stacked and then delivered to a carton for shipment either manually or by the employment of a blister packaging carton packing device.

Thus, generally, a blister packaging system would include a flat card section, with one or more blister packages therein, each of the blister packages sealed to the card and containing an article to be packaged, and with generally the blister often occupying only a portion of the card, the card having printed sales, marketing or user instructions for the article packaged on the other portion. Generally, the blister then extends above the surface of the flat card, and this provides for an asymmetric-type blister package, since generally the blister occupies less than half, say one-third, of one end of the flat card, and with the other end of the flat card often having a small aperture therein to be held on an article display rack.

It is most desirable, in order to save space in the shipment of asymmetric blister packages, to have the blister packaging collated and stacked in an inverted-type arrangement, so that the packing density is considerably reduced in packaging; that is, to have the blister oriented at each end so that the flat back of one card would nest against the flat back of another card with blisters sequentially inverted, thus saving considerable space and packing density. There are collators and stacking apparatuses available to provide for the collation and stacking of asymmetrical blister packaging, that is, to arrange the blister packages in a sequential, end-to-end, back-to-back arrangement in order to save space when the oriented asymmetric packages are collated and stacked and then manually, or by machine, deposited in a shipping carton. While such collating and stacking devices have been reasonably satisfactory, these devices typically are quite complex in operation, and expensive to purchase, operate and maintain.

Therefore, it is desirable to provide for a new and improved blister packaging collator and stacking apparatus, system and method that is simple and effective in operation, easy and inexpensively manufactured, operated and maintained, and which provides for advantages over presently operated blister packaging collator and stacking apparatus, and which may be usefully employed in any packaging system and method.

SUMMARY OF THE INVENTION

The invention relates to a blister packaging, collator and stacking apparatus and a packaging system which includes such collator and stacking apparatus and a method of collating and stacking packages, which packages may be of any shape or size, and in particular blister packages that are asymmetric in shape.

In one preferred illustrated embodiment, the package receiving means comprises at least one sliding tray and at least one inverter tray, preferably a plurality of each tray in an alternating arrangement to provide for a plurality of oriented and inverted packages. However, it is recognized that the package receiving means may comprise only a plurality of inverter trays or a plurality of sliding trays or any combination, sequence or arrangement thereof depending on the packaging requirements and the packages to be collated and stacked.

The collator and stacking apparatus of the invention is adaptable for use in any asymmetric packaging system and method that comprises an apparatus for the collation and stacking of asymmetric packages, such as plastic blister packages, having a blister at or toward one end, and on a flat card, and whereby the packages are desired to be stacked in an oriented, inverted manner in order to promote package density. The apparatus includes a packaging receiving means, which comprises at least one inverter tray with a tray surface and having short, upwardly extending sides on either side, and having one and the other end, and at least one slider tray, having a one and the other end, with short upwardly extending sides and with a tray surface to receive each a blister package on the tray surface of the inverter tray and sliding tray to receive packaging in the same orientation in each tray surface. Typically, the number of inverter and sliding trays may vary and generally may comprise a plurality of inverter and sliding trays, generally such trays being arranged in a general, parallel sequential arrangement. The apparatus includes a first stop means on the inverter tray to position and retain packages on the tray surface as desired, such first stop means generally comprising slidable type paddles slidable along the sides of the inverter tray, which may be manually or automatically adjusted, generally to the length of the package to be received.

The apparatus includes an elongated collation track extending generally perpendicular to the package-receiving means and extending the length thereof, generally having a first and second end adapted to receive in the collation track periodically an inverted package from the inverter tray or trays and a slidable package from the sliding tray or trays in a spaced-apart arrangement on the elongated track means. Where the inverter and sliding trays are arranged in a parallel sequential arrangement, the packages received in the collation track would also be arranged in a spaced-apart, oriented, inverted, sequential arrangement along the track means. The apparatus includes a positioning means, such as two rails on either side of the track means to tilt the received, spaced-apart packages to an inclined position a predetermined amount, such as, for example, the use of sawtooth rails on which the end of each of the flat cards of the packages rest so that the packages are tilted slightly at an angle, for example, of 3–15°, the height of the teeth determined by the height of the plastic blister and the width of the card the blister package forms.

The apparatus includes stacking means to move the inclined packages along the track means to the first or second end of the track, the stacking means moving in a reciprocating manner between the first and second end of the track means, so as to push the aligned, inverted and oriented packages into an end-to-end oriented/inverted, stacked, density arrangement toward one end of, typically the first end, of the track means. The apparatus includes means to pivotably move in a reciprocating manner the inverter or plurality of inverter trays secured to a frame between a package receiving position and an inverted package discharge position, wherein the package is inverted and discharged or placed along the track means.

The apparatus also includes means to move the sliding tray or a plurality of sliding trays, particularly on a frame element in a generally reciprocating, horizontal sliding manner, between the package receiving position and a package discharge position, wherein the packages are slidably discharged from the one end of the sliding tray in an oriented, stacked position and into the track means. The apparatus includes a second overhead stop means to stop or position the packages from the sliding tray within the track means, so that the packages may be received and inclined, and generally would include a pivotable u-shaped stripper arm, with one end of the arm having a downwardly extending finger generally aligned with the surface portion of the one discharge end of the sliding tray, and the other adjacent to the side of the track means, so as to stop and position the package from the sliding tray along the track means.

The apparatus also includes means to discharge the stacked or collated, oriented and inverted packages directly into a carton either manually or by the operation of a machine to a carton or carton packaging means. Typically now densely packed, the asymmetrical packages may be packed for shipment or transportation for subsequent distribution.

Generally, the collating and stacking apparatus provides for a stacking means, a means to move in a reciprocal pivoting manner, and a means to move the sliding tray in a reciprocating sliding manner, the second stop means to operate with a pneumatic or fluidic electrical control, such as pneumatic controls operated by a computer programmed electric circuit, so that the blister type packages may be packaged at a rapid pace. Generally, the collation and stacking apparatus of the invention is placed between a "pick and place" device, so that the "pick and place" device will pick up and position the asymmetric packages within the inverter and sliding trays, and is positioned at the receiving end of a packaging carton filling device, so that the oriented and inverted stacked packages may be directed into a packaging carton. Thus, the collator and stacking apparatus of the invention may be easily integrated into a wide variety of blister packaging systems in place of the collating and stacking apparatus currently in use.

The collating and stacking apparatus, system and method of the invention is directed toward the collation and stacking, typically of asymmetric-type packages, wherein the collation and stacking would lead to increased package density. In all, it is recognized that the collation and stacking device may be employed merely for collation and stacking where there is no advantage in packing density. The collation and stacking apparatus is particularly directed to asymmetric-type packages such as blister-type packages, where the blister is at or adjacent one end, and occupies only a portion of the flat card surface, so that the remaining portion of the package is a flat card, or of a blister of less height, so that it is desired to provide for the inverted, oriented, back-to-back packaging to enhance packaging density of the blister packaging. The blister package could be employed in containing articles that may vary widely in size, nature and type, and may, for example, not even be at that portion of the system containing the articles, so that the collation and stacking apparatus may be employed for the orientation and inversion and stacking of non-article filled blisters, with the articles placed in the blisters later as desired.

The collation and stacking apparatus of the invention as can be seen by the illustration and description hereafter, is a relatively inexpensive, simple apparatus which may be fluidically or electrically powered, typically from an air compressor of the plant system, and may be easily operated and maintained in comparison to prior art collator and stacking apparatus presently employed in the blister packaging field.

The invention will be described for the purposes of illustration only in connection with certain described embodiments; however, it is recognized that those persons skilled in the art may make various modifications, changes, and improvements and additions to the illustrated embodiments without departing from the spirit and scope of the invention.

DESCRIPTION OF THE EMBODIMENTS

Figure 1:
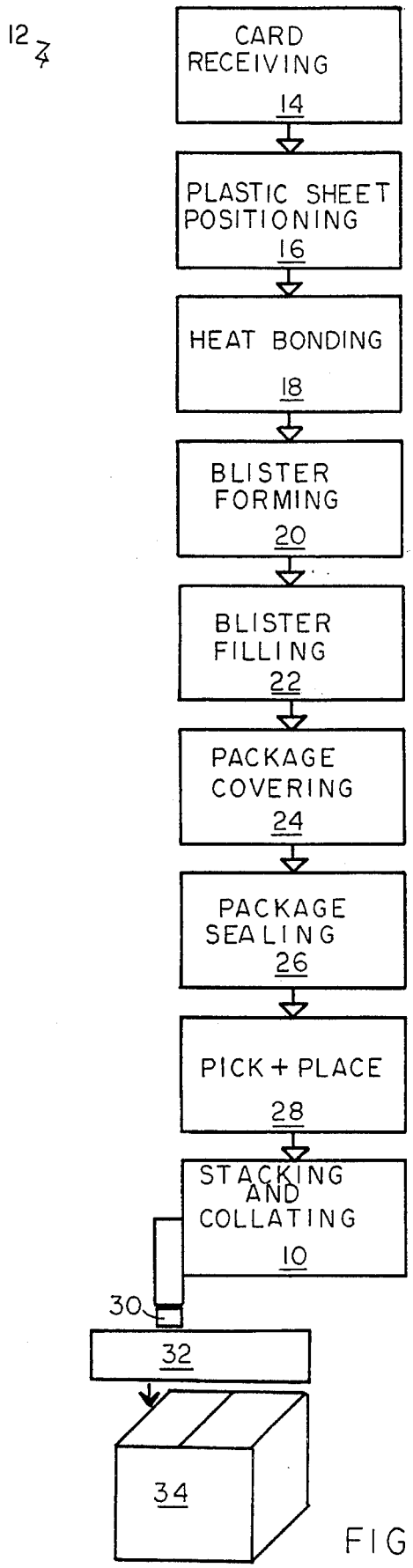
FIG. 1 is a block flow diagram of the collation and stacking apparatus of the invention employed as part of a blister packaging system.

With reference to the drawings, FIG. 1 shows a schematic illustration of the method steps of a collation and stacking apparatus and system of the invention 10 within a total packaging system 12. The method comprises a card-receiving station 14 wherein a flat paper card is received into the system, a plastic sheet positioning station 16 wherein the flat card and plastic sheet are positioned together and a heat bonding station 18 where the two elements are bonded together. The heat bonding station 18 is connected to the blister forming station 20, forming the blister in the thermoformable plastic, and the blister form progresses to the blister filling station 22, where the blister is filled with an article or articles. The blister filling station is connected to the package covering station 24, where the package is enclosed over the article, and at the package sealing station 26 the package is heat sealed together, fully enclosing the article, at which point the blister-packaged article proceeds to a "pick and place" device 28, which picks the blister packages up and places them as desired in the collation and stacking device of the invention 10. After being stacked and collated, the packages 30 are delivered to a carton 34 for shipment by the employment of a blister packaging carton packing device 32.

Figure 2A:
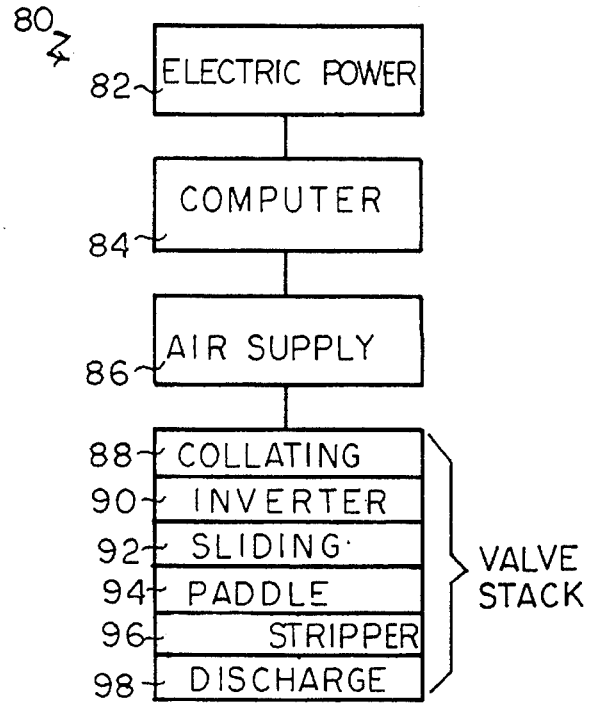
FIG. 2A being a block flow diagram and FIG. 2B being a schematic diagram of the power supply on the collation and stacking apparatus.

FIG. 2 (A and B) shows schematic illustrations of the power supply and valve system of the collation and stacking apparatus of the invention 80, with FIG. 2A detailing the main electric power source 82 connected to a computer 84, programmed to regulate the power and the timing of the air supply 86 furnished to the valve actuator system of the collating and stacking device 10. Six air valve stacks are programmed in a timed manner to complete the steps of the collating and stacking method.

Figure 2B:
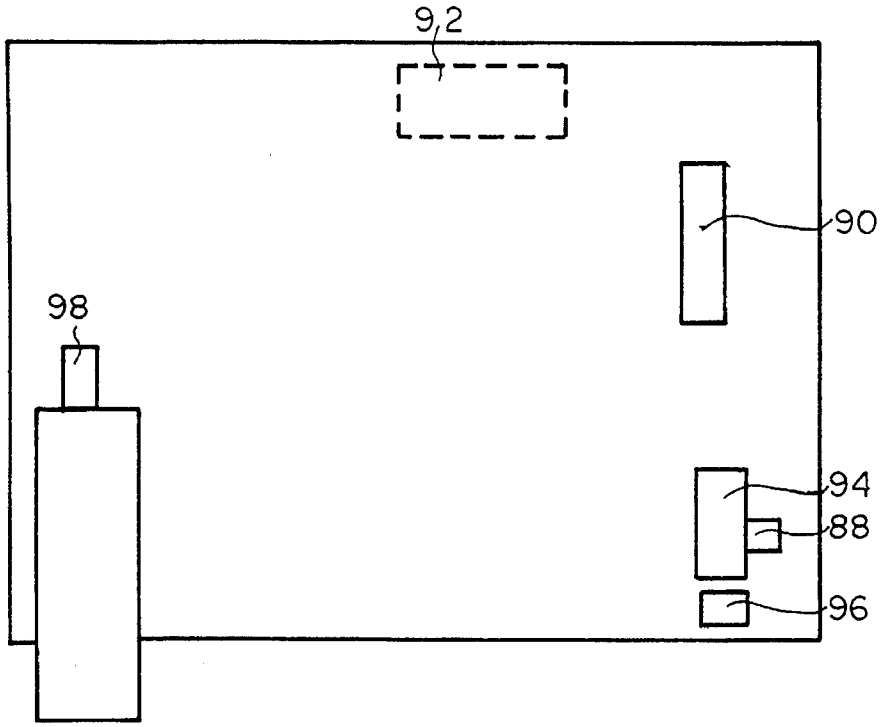
FIG. 2 is a schematic diagram of the power supply of the collation and stacking apparatus of the invention.

As shown in further detail in FIG. 2B, the collating cylinder 88 moves the stacked packages along the track and returns to its original position, with the inverter tray cylinder 90 and sliding tray cylinder 92 operating in a designated manner, the sliding tray cylinder 92 working in conjunction with the package stripper cylinder 96 to remove packages from the sliding trays onto the track rails. The collating paddle cylinder 94 moves the collating paddle from a vertical position when propelling the tilted packages along the track toward the discharge tray to a position horizontal the base of the collator and stacking device when it is retracting to its non-use position. The discharge cylinder 98 is then activated to propel the stacked and collated packages out of the stacking and collating device to the carton packing device. The pneumatic cylinders and actuators employed are commonly used in the industry, for example, pneumatic cylinders manufactured by Parker Motion and Control, Automation Actuator Division, Wadsworth, Ohio 44281.

Figure 3:
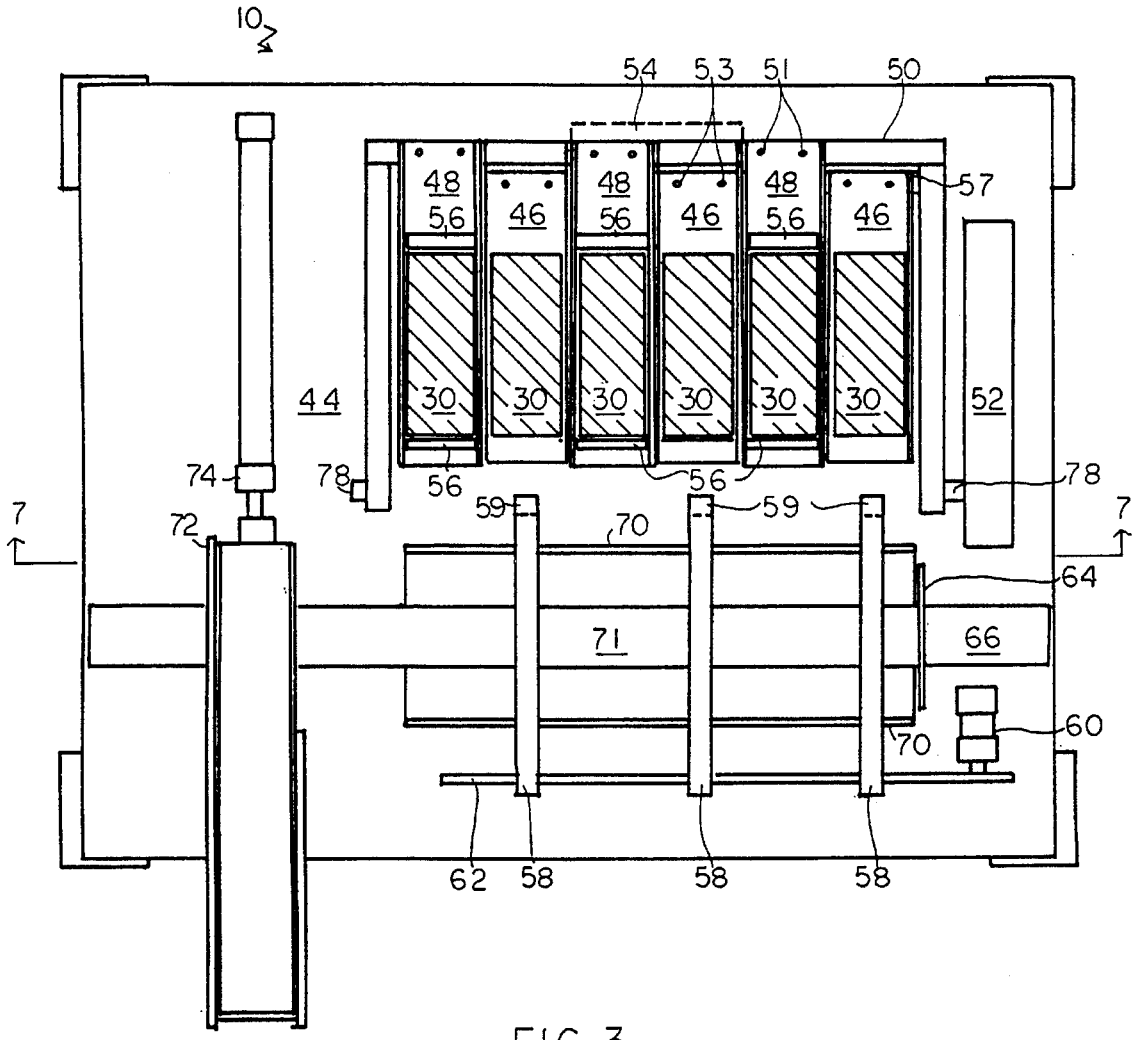
FIG. 3 is a top plan view of the collation and stacking apparatus of the invention in a non-activated position.

FIG. 3 is a top plan view of the collation and stacking apparatus 10 of the invention in a non-use position, with a base 44 having inverter trays 48 mounted on an inverter tray support bar 50 with fasteners 51 at one end and stops 56 to retain blister packages 30. The base 44 also has sliding trays 46 fastened to sliding tray support bars 57 with fastening means 53, the sliding tray support bar 57 having an actuator 54 to move the sliding tray in a slidable, horizontal manner.

The inverter trays 48 and support bar 50 have at the opposite end a pivot bar 78 connected to the base and to a pivot actuator 52 to move the inverter trays in an upward, pivotable manner in order to invert the oriented packages retained in the inverter trays and position them in a stacking track 71. Other blister packages 30, having been placed on sliding trays 46 and moved in a slidable manner by sliding actuator 54 to a position directly over the rails 70 of the stacking track 71, are stripped from the sliding trays by a plurality of overhead stripper arms 58 having downwardly extending stripper fingers 59 to position the oriented packages 30 over the track 71 while the sliding trays return to their point of origin. The stripper arms 58 are connected to the base 44 by a pivotable retaining bar 62 with a pivotable actuator motor 60 to move the bar in a pivotable manner in conjunction with the other steps. The stacking track 71 is positioned perpendicular to and directly adjacent the sliding and inverting trays and has two upwardly extending, sawtooth track rails 70 to position the packages 30 in a tilted manner and in an alternating, inverted/oriented relationship, so that the stacking paddle 64, positioned between the track rails 70, can be actuated by the paddle actuator 66 and move in a slidable manner down the track, stacking the tilted, inverted/oriented packages in a stacked manner and into the discharge tray 72, where the stacked packages are moved forward by a discharge cylinder 74 into the carton packaging device 32.

Figure 4:
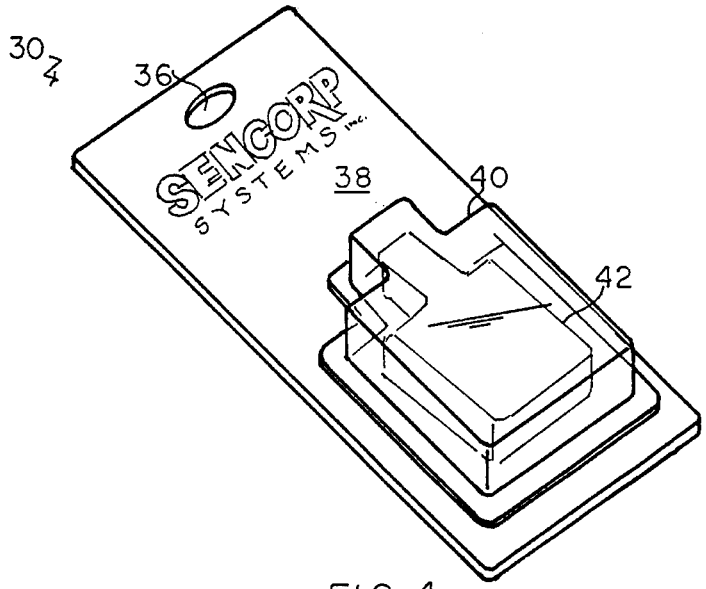
FIG. 4 is a perspective view of an asymmetric plastic blister package as used in this collation and stacking method.

FIG. 4 is a perspective view from above of a blister package 30 that would typically be employed in the collating and stacking device of the invention 10, with a flat card section 38 for indicia or other markings, a blister form article-enclosure section 40, enclosing an article 42, and an opening 36 on the flat card section 38 for shipping and display purposes.

Figure 5:
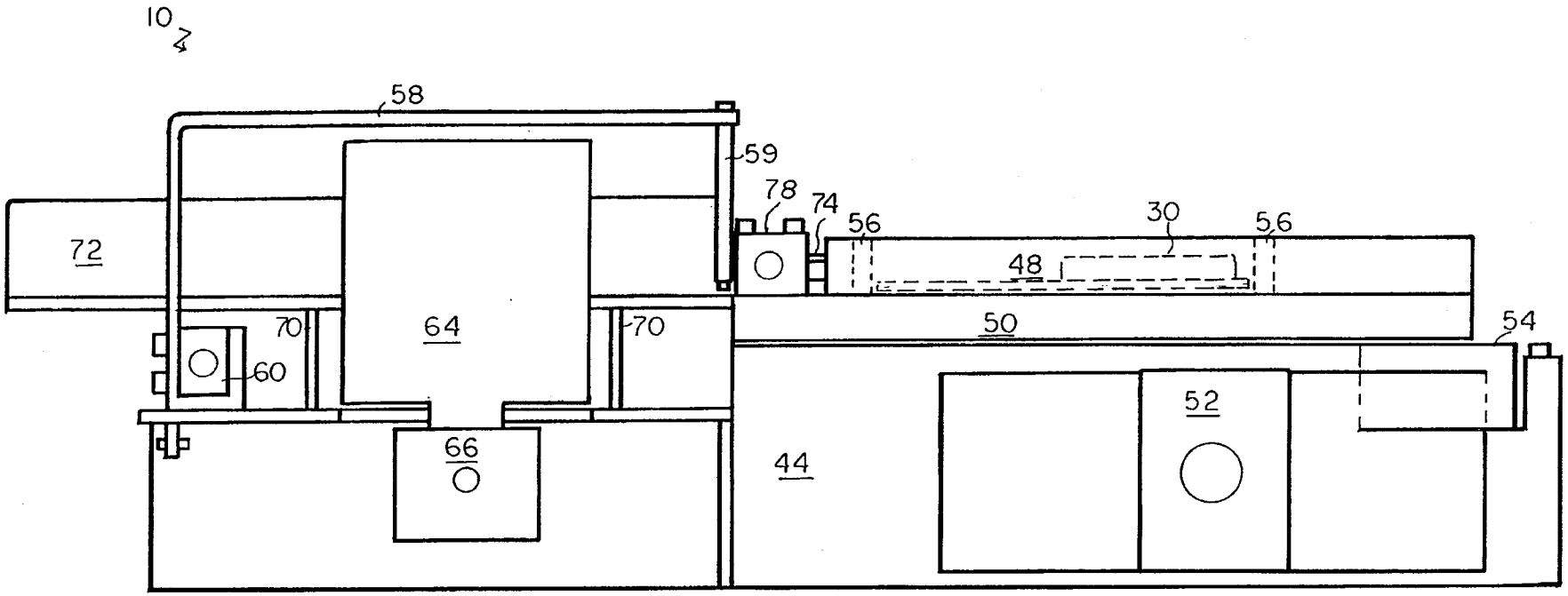
FIG. 5 is a side elevational view of the collation and stacking apparatus of the invention in a loaded, non-activated position, prior to inversion and sliding of the trays.

FIG. 5 is a side elevational view of the collating and stacking apparatus of the invention 10 in a non-activated position, with the base 44 supporting the sliding tray bar 55, the sliding tray 46 and the sliding tray actuator 54, and the inverter tray bar 50, the inverter trays 48 and the inverter tray actuator 52, both tray configurations in a resting position with packages 30 therein. The receiving track 71, with sawtooth track rails 70 on either side are positioned to support and tilt the packages, and the track paddle 64 and paddle actuator 66 are also shown in their non-activated, vertical position. The package stripper arms 58 with downwardly extending fingers 59 are positioned over the track 71 and extend downwardly into the sliding trays 46 for stripping of the packages 30 from the sliding trays and onto the track 71. The stripper arm 58 is connected to the base 44 by the pivotable stripper arm retaining bar 62, which is further connected to the package stripper actuator 60 to provide for pivotable movement of the stripper arms when activated. The discharge tray 72 and discharge cylinder 74 is also shown, which provides for the discharge of the stacked and collated packages to the carton packing device 32.

Figure 6:
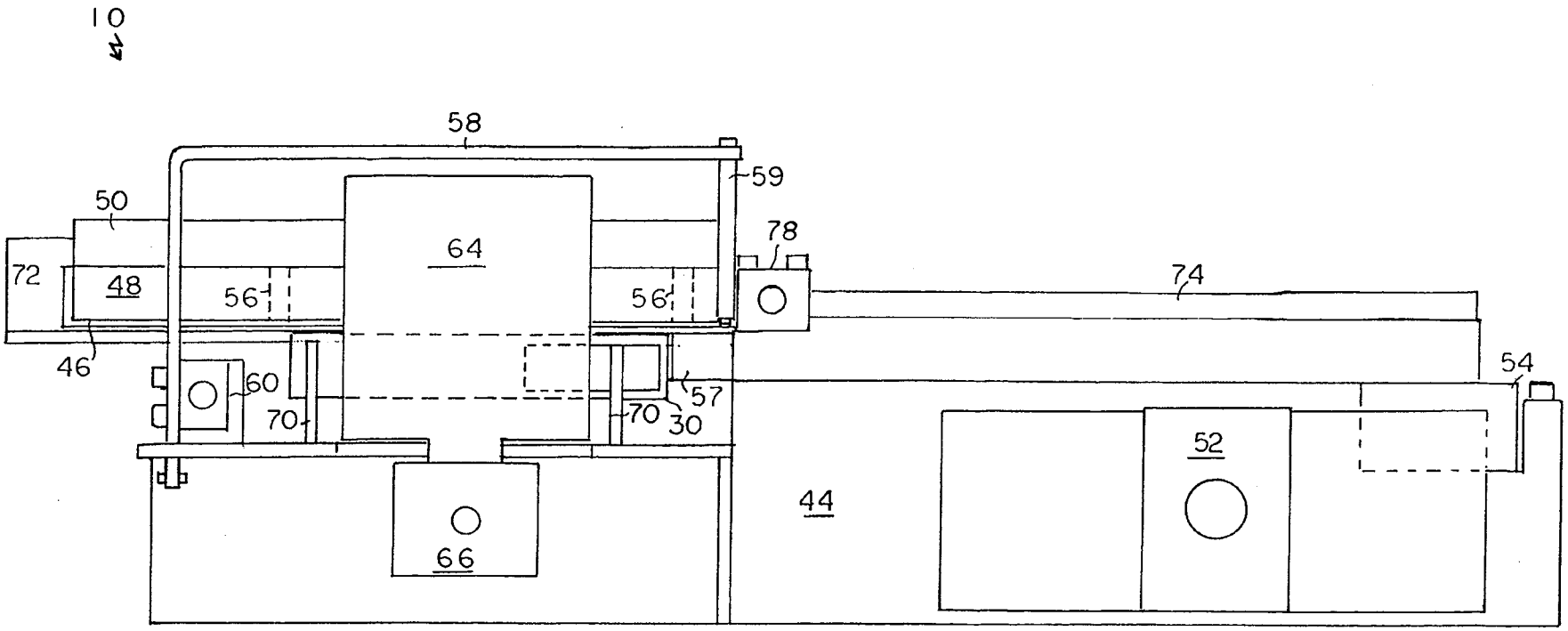
FIG. 6 is a side elevational view of the collation and stacking apparatus of the invention in the activated inversion and sliding position.

FIG. 6 shows a side elevational view of the collator and stacking device 10 in an activated mode, with the inverter trays 48 being moved pivotably upwardly by the inverter tray actuator 52 to invert the packages therein and place them onto the track rails 70 of the stacking track 71, and the sliding trays 46 being moved horizontally by the sliding tray motor 54 moving the sliding tray support bar 55 to a position over the track 71, and the package stripper arm 58 with finger 59 positioned to retain the packages 30 over the track 71 upon the retraction of the sliding trays 46.

Figure 7:
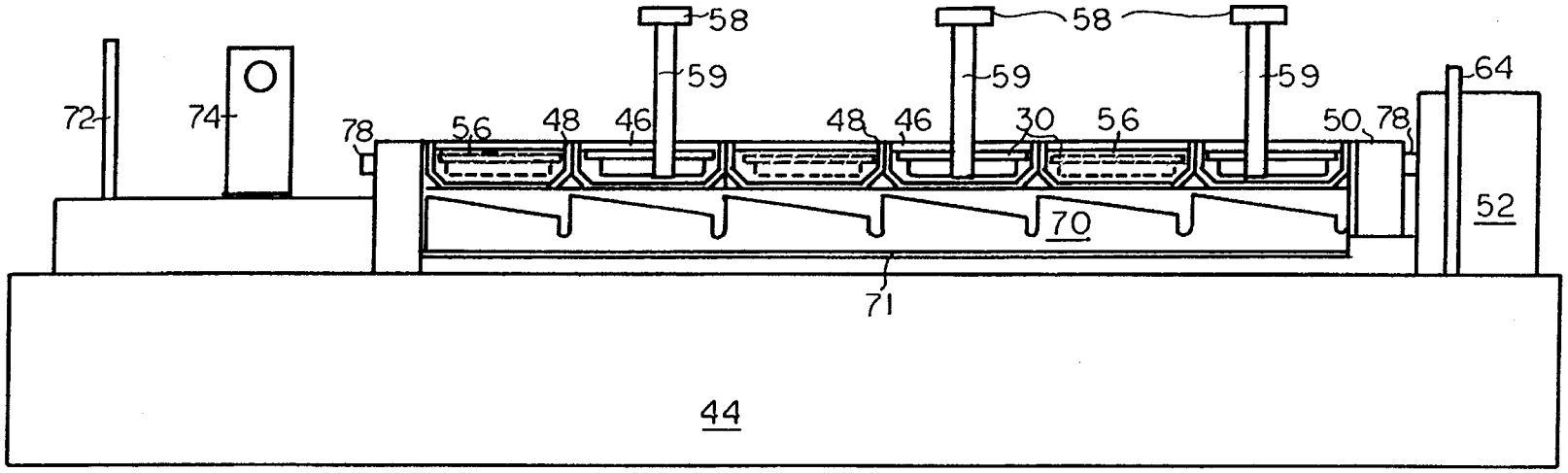
FIG. 7 is a side sectional view, cut along lines 7—7 of FIG. 3, of the stacking track in a receiving position, with oriented blister packages on the trays.

FIG. 7 shows a side sectional view of the stacking track 71 with sawtooth rails 70 in a receiving position, with the track rails 71 supporting the inverted and oriented packages in a tilted manner prior to being pushed and stacked together by the stacking paddle 64 into the discharging tray 72.

Figure 8:
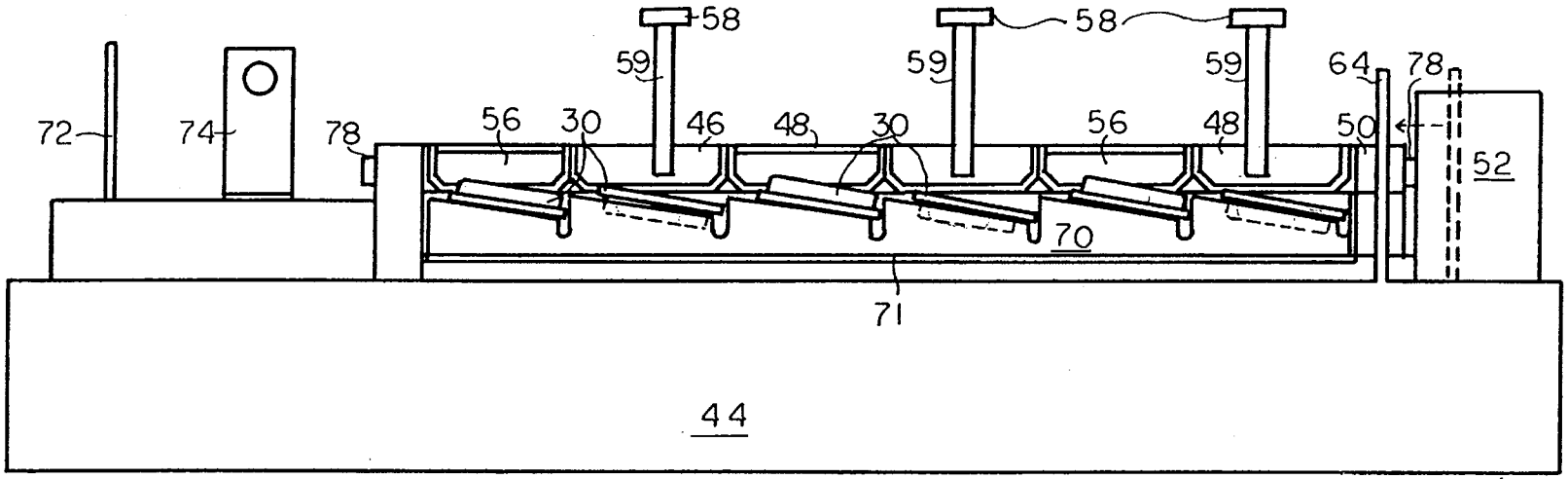
FIG. 8 is a side sectional view of the stacking track in a stacking position with oriented and inverted blister packages thereon.

FIG. 8 shows a side sectional view of the stacking track 71 with the stacking paddle 64 activated to push the tilted inverted and oriented packages toward the end of the track 71 and stacking the packages into the discharging tray 72.

Figure 9:
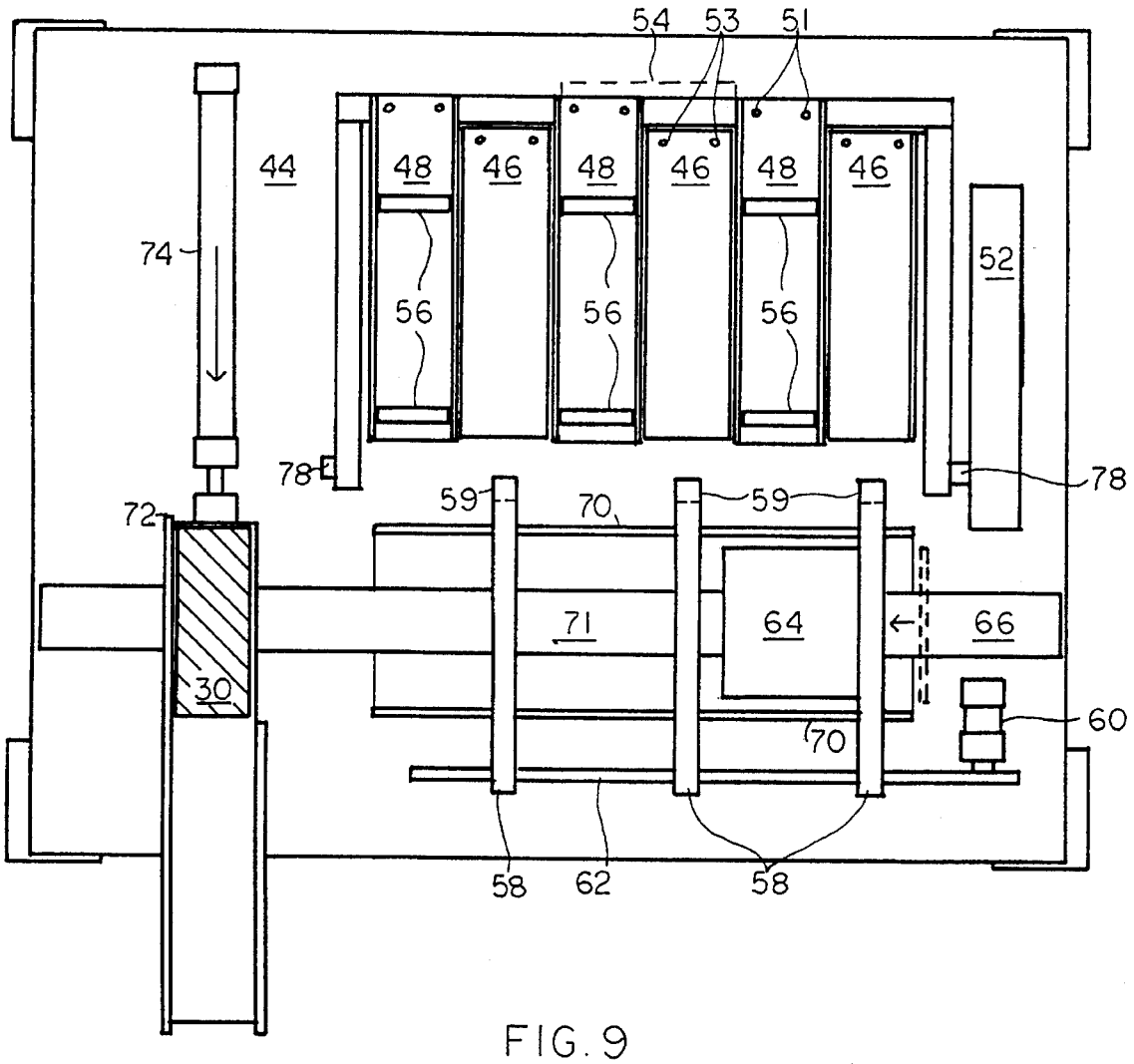
FIG. 9 is a top plan view of the stacked blister packages at the end of the stacking track prior to being discharged from the discharge tray.

FIG. 9 further depicts the stacked inverted and oriented packages in the discharge tray 72, with the discharge cylinder pushing them out into the carton packing device. FIG. 9 also shows the track paddle 64 in its horizontal retraction position moving in a slidable, reciprocating manner within the track 71 and along the base 44 to provide for the continuating of the inverting and sliding process for the next group of packages.

Figure 10:
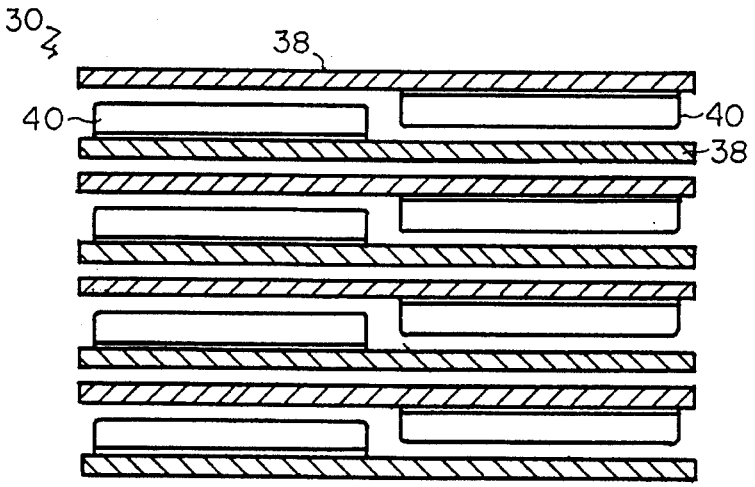
FIG. 10 is a side elevational view of the oriented and inverted stack of asymmetric blister packages.

FIG. 10 shows a stack of the inverted and oriented packages in a side elevational view as they would appear in the discharge tray 72, showing the packages 30 with the flat card area 38 and the blister package area 40 stacked in a snug, reciprocating manner.

In operation, the collating and stacking apparatus of the invention 10 is positioned within a total packaging system 12, shown in this embodiment as a blister packaging system, with the entire system operated electrically with an electrical power source 82 and controlled by a computerized timer 84 and regulation device. The independent actuators are comprised of air-powered cylinders and valves 88–98.

The packages 30 are placed into the collating and stacking device of the invention 10 by a "pick and place" device 28, with the desired number of packages placed in the desired number of trays. While this apparatus can be used with any combination of size and number of inverter and sliding trays as desired by the manufacturer, and can even be used with one type of tray exclusively, this preferred embodiment uses a combination of sliding and inverter trays of similar size.

After the packages 30 have been deposited into the respective trays, the inverter tray actuator 52, with the inverter tray pivotable support bar 50 at one end, moves the other end of the support bar with the inverter trays 48 fastened thereon upwardly and over in a pivotable manner to invert the trays and the packages therein, said packages being retained in position by manually controlled stops 56, and the inverted packages are then positioned on the rails 70 in the stacking track 71, while simultaneously the sliding trays 46 are moved in an inward, sliding, horizontal manner to position the oriented packages on the alternating rails on the stacking track 71, where the overhead stripper arms 58, with downwardly extending fingers 59 retain the packages 30 in their position over the track rails 70 while the sliding tray 46 retracts to its original position, thereby placing the oriented packages in the track 71 in a tilted manner, in an alternating arrangement with the inverted packages.

The track stacking paddle 64 is then activated, pushing the tilted inverted and oriented packages along the track rails 70, to the other end of the track 71, where they are deposited in the discharge tray 72 in a stacked, oriented and inverted manner, with, for example, the blister sides 40 facing each other in a snugly fit alternating relationship, and with the flat sides of the packages being adjacent each other. Upon arrival of the stacked packages in the discharge tray 72, the discharge cylinder 74 is activated and slidably moves the stacked and collated packages into the carton packing machine 32 and into a packing carton 34.

The air valves are programmed and structured for maximum speed and efficiency in the packaging method; for example, while the stacked and collated packages are being discharged, the track paddle 64 is retracted in its extended, horizontal position to enable the sliding and inverting trays to load a new set of packages into the track to repeat the process.

It should be noted that all parts of the stacking and collating apparatus are interchangeable with the lengths and widths of the trays and other parts may be varied as desired, to enable the user to accommodate different sized packages and packing arrangements as desired, and the retooling can be accomplished by an equipment maintenance engineer with ordinary mechanical skill using standard equipment. Thus the stacking and collating system, method and apparatus of the invention is easy and inexpensive to assemble, operate and maintain, and provides a greater variety of applications as part of a packaging system.

What is claimed is:

1. A collator and stacking apparatus for the collation and stacking of asymmetric packages, which apparatus comprises:

a) package receiving means which comprises at least one inverter tray with a tray surface, having short, upwardly extending sides on either side and having a one and an other end to receive a package to be inverted and at least one sliding tray having a one and other end, short, upwardly extending sides and with a tray surface to receive an oriented package not to be inverted, with each tray surface arranged generally parallel and adjacent to each other and arranged to receive each a package thereon to be collected and stacked, the received package arranged in the same orientation on each of the inverted and sliding tray surfaces;

b) first stop means on the inverter tray to position the received package on the tray surface;

c) an elongated collation track means generally perpendicular to the package receiving means and having a first and second end to receive in a collation track periodically an inverted package from the inverter tray and a non-inverted oriented package slid from the sliding tray in a spaced-apart arrangement within the track means;

d) positioning means in the track means on each side to tilt the received spaced-apart inverted and non-inverted oriented packages to a predetermined inclined position;

e) stacking means to move the inclined positioned packages within the track means to the first end of the track, the stacking means moving in a reciprocating manner between the first and second end of the track means to provide a stack of inverted and non-inverted oriented packages;

f) means to move in a reciprocating pivotable manner the inverter tray between an oriented package receiving position and an inverted package discharge position wherein the package on the tray surface is inverted and placed within the track means;

g) means to move the sliding tray in a reciprocating sliding manner between an oriented package receiving position and a non-inverted package discharge position wherein the packages are slidably discharged from one end of the sliding tray in an oriented non-inverted stacked position into the track means;

h) second stop means to stop and position the non-inverted oriented package from the sliding tray within the track means; and i) means to discharge a collated, alternated stack of the non-inverted oriented and inverted stacked packages from the one end of the track means.

2. The apparatus of claim 1 wherein the package receiving means comprises a plurality of generally parallel, sequentially arranged inverter trays and sliding trays, said trays arranged generally along one side of the track means and generally perpendicular to the track means.

3. The apparatus of claim 2 which includes a plurality of inverter trays wherein the inverter trays are supported on a pivotable frame element which pivots the inverter trays between the package receiving and the package discharge position.

4. The apparatus of claim 2 which includes a plurality of generally parallel sliding trays supported on a frame wherein the frame is slidably movable in a generally horizontal plane between the package receiving position and the non-inverted package discharge position.

5. The apparatus of claim 1 wherein the first stop means comprises a pair of spaced-apart, slidable, movable stops on the inverter trays and arranged in distance depending on the length of the package to be received and inverted.

6. The apparatus of claim 1 wherein the means to move the inverter tray comprises a mechanical gear pneumatic cylinder.

7. The apparatus of claim 1 wherein the means to move the sliding tray comprises a pneumatic means.

8. The apparatus of claim i wherein the second stop means comprises a U-shaped arm element having one and an other end for pivotable movement between stopping the received, non-inverted oriented package in the track means in position and stopping the received, oriented package in the sliding tray in position and means to pivot the second stop means.

9. The apparatus of claim 8 which includes rod means along one side of the track means and the second stop means adjustably positioned for slidable adjustment on the rod means to a position whereon one end is arranged opposite the end of each sliding tray.

10. The apparatus of claim 1 wherein the stacking means comprises a pneumatically activated paddle which is positioned to move slidably between the first and second end of and within the track means.

11. The apparatus of claim 10 wherein the pusher paddle is pivotably mounted to move between a generally perpendicular upright, pushing, stacking position in moving from the second end to the first end and at an angularly inclined position within the track means in moving from the first to the second end.

12. The apparatus of claim 1 wherein the positioning means comprises generally a plurality of upright, sawtooth elements having a top surface on either side of the track means to position the packages at similar sequential inclined angles from each other on the top surfaces of the sawtooth elements.

13. The apparatus of claim 12 wherein the height of the sawtooth elements at one end is slightly greater than the greatest height of the package and the height at the other end of the sawtooth element is slightly greater than the smallest height of the package.

14. The apparatus of claim 1 which comprises integrated pneumatic-electrical control means to provide for the controlled, automatic reciprocating movement of the pivotable inverter tray, the slidable sliding tray, the second stop means and the slidable stacking means to provide for the automatic collation and stacking of the packages.

15. The apparatus of claim 1 adapted to collate and stack a plurality of identical packages in an inverted plastic blister package end-to-end oriented high density packaging arrangement, with the package comprising a flat sheet element having an article containing plastic blister at or toward the one end of the sheet element.

16. A blister packaging system for the production of article-filled plastic blister packages on a sheet material which system includes the collator apparatus of claim 1.

17. The system of claim 16 which includes a pick and place means to pick up article-containing plastic blister packages and place the blister packages in the package receiving means of the collator apparatus.

18. The system of claim 16 which includes a container means to receive the stacked and oriented packages from the discharge means.

19. The apparatus of claim 1 which includes a packaging station and a means to move in a reciprocating manner the inverted, oriented stacked, collated packages from the discharge end of the track means to the packaging station.

20. A collator and stacking apparatus for the collation and stacking of asymmetric plastic blister packages, which apparatus comprises:

a) package receiving means which comprises a plurality of inverter trays with a tray surface, having short, upwardly extending sides on either side and having a one and an other end, wherein the inverter trays are supported on a pivotable frame element which pivots between a package receiving position and an inverted package discharge position, and a plurality of sliding trays having a one and other end, short, upwardly extending sides and with a tray surface supported on a frame wherein the frame is slidably movable in a generally horizontal plane, between a package receiving position and a package non-inverted oriented discharge position, each of said tray surfaces arranged and constructed in a generally parallel alternating sequence and each tray surface arranged to receive a package thereon, the received packages received in the same orientation arrangement on each tray surface;

b) first stop means on the inverter tray to position the received package on the tray surface;

c) an elongated collation track means generally perpendicular to the package receiving means and having a first and second end to receive in a collation track periodically an inverted package from the inverter tray and a non-inverted, oriented package from the sliding tray in a spaced-apart arrangement within the track means;

d) positioning means in the track means on each side to tilt the received spaced-apart packages to an inclined position a predetermined amount depending on the size of the package;

e) stacking means to move the inclined packages within the track means to the first end of the track, the stacking means moving in a reciprocating manner between the first and second end of the track means to provide a stack of inverted and non-inverted oriented packages;

f) means to move in a reciprocating pivotable manner the inverter tray between the package receiving position and an inverted package discharge position wherein the package is inverted and placed within the track means;

g) means to move the sliding tray in a reciprocating sliding manner between the package receiving position and a non-inverted, oriented package discharge position wherein the packages are slidably discharged in a non-inverted oriented stacked position within the track means;

h) second stop means to stop and position the packages from the sliding tray within the track means;

i) means to discharge the stack of collated, stacked packages from the first or second end of the track means, the packages arranged in a stacked position, alternating with inverted and non-inverted oriented packages in the stack.

21. A blister packaging system for the production of article-filled plastic blister packaging, which package comprises a flat sheet material and an article-filled plastic blister at or toward one end of the package and which system includes the collator and stacking apparatus of claim 20, and also includes:

a) pick-and-place means to pick and place the blister package on the package-receiving means; and b) a container means to receive from the track means and to place the alternately arranged, inverted, oriented, collated and stacked packages into packaging cartons.

22. A collator and stacking method for the collation and stacking of asymmetric plastic blister packages having a blister at or toward one end on a fiat card, which method comprises:

a) providing a package receiving means comprising at least one inverter tray with a tray surface, said tray surface having upwardly extending sides on either side and having a one and an other end, and at least one sliding tray having a one and other end, and having short, upwardly extending sides and having a tray surface, the inverter tray and the sliding tray arranged in a generally parallel adjacent relationship;

b) receiving a package on each tray surface, the received packages all arranged in the same orientation position on each tray surface;

c) positioning a first stop means on the inverter tray to position the received package on the tray surface;

d) receiving in an elongated collation track means arranged generally perpendicular to the package receiving means and having a first and second end for receiving in the collation track an inverted package from the inverter tray and a non-inverted oriented package from the sliding tray to provide for inverted and non-inverted packages in a spaced-apart arrangement within the track means;

e) positioning in an inclined position in the track means the received spaced-apart inverted and non-inverted packages;

f) stacking the inclined packages within the track means by moving a stacking means in a reciprocating manner between the first and second end of the track means, to provide a stack of inverted and oriented packages;

g) moving in a reciprocating pivotable manner the inverter tray between a package receiving position and an inverted package discharge position wherein the package is inverted and discharged from the inverter tray into an inverted package position in the track means;

h) sliding the tray in a reciprocating sliding manner in a horizontal plane between the package receiving position and a non-inverted, oriented package discharge position, so that the packages are slidably discharged from one end of the sliding tray into an oriented, stacked position into the track means; and i) discharging the stack of the non-inverted oriented and inverted stacked packages from the one end of the track means.

23. The method of claim 22 which includes moving the inverted packages and the non-inverted packages to provide a stack of alternately arranged end-to-end inverted and non-inverted blister packages.

24. The method of claim 22 which includes directing plastic blister packages from a pick and place apparatus into the package receiving means in the same oriented position on the inverted trays and sliding trays.

25. The method of claim 22 which includes positioning the inverted and non-inverted packages within the track means at an inclined angle of from about 3 to 15 degrees.

* * * * *